US010533783B2

(12) United States Patent
Xue et al.

(10) Patent No.: US 10,533,783 B2
(45) Date of Patent: Jan. 14, 2020

(54) AIR CONDITIONER HAVING COMPRESSOR BYPASS AND EVALUATION OF VOLUME OF CONNECTING PIPE

(71) Applicant: Hitachi-Johnson Controls Air Conditioning, Inc., Tokyo (JP)

(72) Inventors: Jun Xue, Tokyo (JP); Koji Naito, Tokyo (JP); Atsuhiko Yokozeki, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 16/214,377

(22) Filed: Dec. 10, 2018

(65) Prior Publication Data

US 2019/0331374 A1 Oct. 31, 2019

Related U.S. Application Data

(63) Continuation of application No. PCT/JP2018/017098, filed on Apr. 26, 2018.

(51) Int. Cl.

*F25B 41/04* (2006.01)
*F25B 49/02* (2006.01)
*F25B 13/00* (2006.01)

(52) U.S. Cl.

CPC ..... *F25B 41/04* (2013.01); *F25B 13/00* (2013.01); *F25B 49/022* (2013.01);
(Continued)

(58) Field of Classification Search

CPC ..... F25B 2345/00; F25B 2345/002; F25B 2345/003; F25B 2345/006;
(Continued)

(56) References Cited

U.S. PATENT DOCUMENTS 6,023,935 A 2/2000 Okazaki et al.
2005/0028552 A1* 2/2005 Nishijima ..... F25B 31/004 62/500

(Continued)

FOREIGN PATENT DOCUMENTS

CN 101490485 B 3/2011
CN 102016458 B 7/2013

(Continued)

OTHER PUBLICATIONS

Taiwanese Office Action received in corresponding Taiwanese Application No. 107145800 dated Mar. 18, 2019.

(Continued)

*Primary Examiner* — Edward F Landrum
*Assistant Examiner* — Daniel C Comings
(74) *Attorney, Agent, or Firm* — Mattingly & Malur, PC

(57) ABSTRACT

An air conditioner including an outdoor device that includes a bypass path connecting a discharge side of the compressor and a suction side of the compressor, an on-off valve configured to open/close the bypass path, and a control device configured to control the compressor, the decompression device, and the on-off valve. The control device opens the on-off valve in a state in which the compressor is stopped to execute such bypass opening that refrigerant circulates, through the bypass path, from the discharge side of the compressor in a refrigerant storage state in which refrigerant is stored to the suction side of the compressor in a substantially vacuum state, and evaluates a volume of the pipe.

4 Claims, 5 Drawing Sheets

(52) U.S. Cl.
CPC ..... *F25B 2400/0401* (2013.01); *F25B 2600/2501* (2013.01); *F25B 2700/1931* (2013.01); *F25B 2700/1933* (2013.01)

(58) Field of Classification Search
CPC ..... F25B 2400/0401; F25B 2400/19; F25B 2600/2501; F25B 2700/193; F25B 2700/1931; F25B 2700/1933
See application file for complete search history.

(56) References Cited

U.S. PATENT DOCUMENTS

| | | | |
|---|---|---|---|
| 2009/0031739 | A1 | 2/2009 | Kasahara et al. |
| 2009/0260376 | A1 | 10/2009 | Kasahara et al. |
| 2011/0000234 | A1 | 1/2011 | Nishimura et al. |

FOREIGN PATENT DOCUMENTS

| | | | | |
|---|---|---|---|---|
| JP | 11-316058 | A | 11/1999 | |
| JP | 2001-280756 | * | 10/2001 | ..... F25B 41/00 |
| JP | 2001-280756 | A | 10/2001 | |
| JP | 2006-183979 | * | 7/2006 | ..... F25B 49/02 |
| JP | 2006-183979 | A | 7/2006 | |
| JP | 2007-240108 | A | 9/2007 | |
| KR | 10-0791320 | B1 | 1/2008 | |
| WO | 2017/183068 | A1 | 10/2017 | |

OTHER PUBLICATIONS

International Search Report and Written Opinion of PCT/JP2018/017098 dated Jul. 17, 2018.
Korean Office Action received in corresponding Korean Application No. 10-2018-7032279 dated Oct. 8, 2019.

* cited by examiner

AIR CONDITIONER HAVING COMPRESSOR BYPASS AND EVALUATION OF VOLUME OF CONNECTING PIPE

CROSS-REFERENCE TO RELATED APPLICATION

This application is a continuation application of PCT/JP2018/017098 filed on Apr. 26, 2018, the entire contents of which are hereby incorporated by reference.

BACKGROUND

1. Technical Field

The present disclosure relates to an air conditioner.

2. Description of the Related Art

It has been known that in an air conditioner configured to evaluate a volume of a pipe connecting an outdoor device and an indoor device, a control parameter of an expansion valve and the like is, for improving reliability, adjusted according to the pipe connecting the outdoor device and the indoor device. However, there are some cases where it is difficult to directly measure the pipe (e.g., a case where an existing pipe is directly utilized and only an air conditioner is redesigned), and for this reason, the method for indirectly evaluating a pipe length has been proposed.

For example, in a typical technique disclosed in JP-A-2006-183979, it has been proposed that cooling operation of an air conditioner is performed to calculate the length of a low-pressure gas pipe based on a pressure loss of the low-pressure gas pipe obtained from a suction pressure of a compressor and a saturated pressure of an indoor heat exchanger.

Moreover, in a typical technique disclosed in JP-A-2001-280756, it has been proposed that a refrigerant circuit pipe length is derived based on an elapsed time until a discharge gas temperature of a compressor changes to a predetermined temperature after the opening degree of an expansion valve has been forcibly changed in cooling operation.

SUMMARY

An air conditioner according to an embodiment of the present disclosure, includes an outdoor device including a compressor and an outdoor heat exchanger, an indoor device including an indoor heat exchanger and a decompression device, and a pipe connecting the outdoor device and the indoor device, wherein the outdoor device includes a bypass path connecting a discharge side of the compressor and a suction side of the compressor, an on-off valve configured to open/close the bypass path, and a control device configured to control the compressor, the decompression device, and the on-off valve, and the control device opens the on-off valve in a state in which the compressor is stopped to execute such bypass opening that refrigerant circulates, through the bypass path, from the discharge side of the compressor in a refrigerant storage state in which refrigerant is stored to the suction side of the compressor in a substantially vacuum state, and evaluates a volume of the pipe connecting the outdoor device and the indoor device based on at least one of a pressure on the discharge side of the compressor, a pressure change on the suction side of the compressor and a time required for the pressure change on the suction side of the compressor in the bypass opening.

DESCRIPTION OF THE EMBODIMENTS

Figure 1:
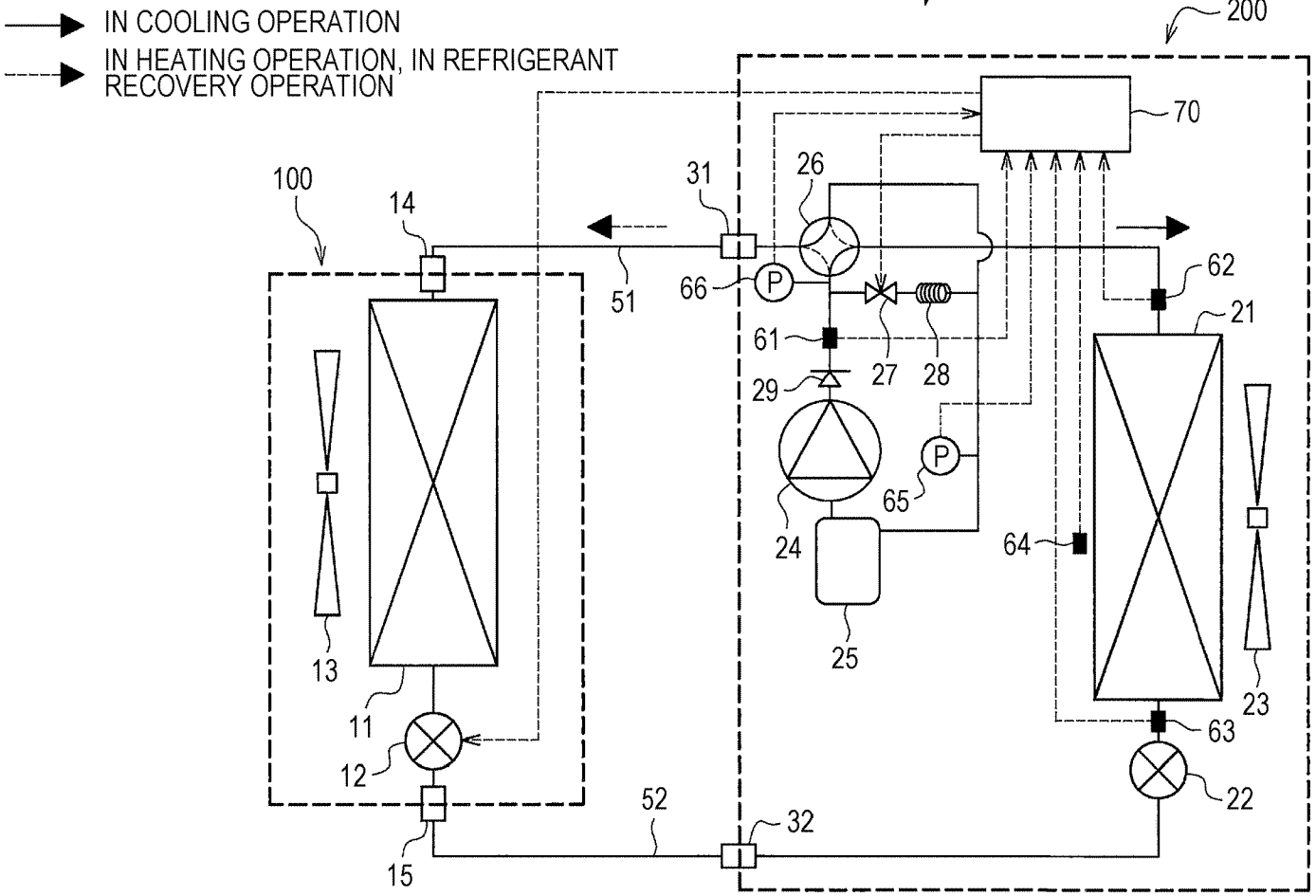
FIG. 1 is an entire configuration diagram of the outline of an air conditioner according to the present embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, in the typical techniques described in Patent Literature 1 and Patent Literature 2, a proper amount of refrigerant is enclosed in the air conditioner, and these techniques can be implemented as long as the cooling operation can be performed. In other words, there is a problem that the pipe length cannot be evaluated during a low-air-temperature period or before enclosing of additional refrigerant.

Moreover, in the typical technique described in Patent Literature 1, the pressure loss is influenced not only by the pipe length but also by various factors such as the presence or absence of a curved portion of a pipe and the flow rate of refrigerant flowing in the pipe. For this reason, at least a pipe shape and a pipe diameter need to be grasped for accurately evaluating the length of the low-pressure gas pipe. In the case of the existing pipe, it is extremely difficult to research such a pipe.

Further, in the typical technique described in Patent Literature 2, the elapsed time until the discharge gas temperature of the compressor changes to the predetermined temperature after the opening degree of the expansion valve has been forcibly changed is influenced not only by a connection pipe thermal capacity but also by thermal capacities of the compressor and a heat exchanger, the amount of refrigerant held by the air conditioner, a surrounding temperature, and the like. However, the compressor and the heat exchanger to be mounted and the held refrigerant amount vary according to the capacity and type of the air conditioner. Moreover, the surrounding temperature is also influenced by installation location and time of the air conditioner. For this reason, it is not easy to ensure the accuracy of evaluation of the pipe length.

An air conditioner of the present embodiment has been developed for solving the typical problems, and is intended to provide an air conditioner configured so that the volume of each pipe connecting an outdoor device and an indoor device can be accurately evaluated.

According to the present embodiment, the air conditioner includes an outdoor device including a compressor and an outdoor heat exchanger, an indoor device including an indoor heat exchanger and a decompression device, and a pipe connecting the outdoor device and the indoor device. The outdoor device includes a bypass path connecting a discharge side of the compressor and a suction side of the compressor, an on-off valve configured to open/close the bypass path, and a control device configured to control the compressor, the decompression device, and the on-off valve. The control device opens the on-off valve in a state in which the compressor is stopped to execute such bypass opening that refrigerant circulates, through the bypass path, from the discharge side of the compressor in a refrigerant storage state in which refrigerant is stored to the suction side of the compressor in a substantially vacuum state, and evaluates the volume of the pipe connecting the outdoor device and the indoor device based on at least one of a pressure on the discharge side of the compressor, a pressure change on the suction side of the compressor and a time required for the pressure change on the suction side of the compressor in the bypass opening.

According to the present embodiment, the air conditioner can be provided, which is configured so that the volume of each pipe connecting the outdoor device and the indoor device can be accurately evaluated.

First, an air conditioner according to the present embodiment will be described with reference to FIG. 1. FIG. 1 is an entire configuration diagram (a cycle system diagram) of the outline of the air conditioner according to the present embodiment.

As illustrated in FIG. 1, the air conditioner 1 includes an indoor device 100, an outdoor device 200, and pipes 51, 52 connecting the indoor device 100 and the outdoor device 200.

The indoor device 100 includes an indoor heat exchanger 11 configured to exchange heat between refrigerant and indoor air, an indoor expansion valve (a decompression device) 12 configured to decompress refrigerant, an indoor fan 13 configured to supply the indoor air to the indoor heat exchanger 11, a connection port 14 to which the pipe 51 is connected, and a connection port 15 to which the pipe 52 is connected.

The outdoor device 200 includes an outdoor heat exchanger 21 configured to exchange heat between refrigerant and external air, an outdoor expansion valve 22 configured to decompress refrigerant, an outdoor fan 23 configured to supply the external air to the outdoor heat exchanger 21, a compressor 24 configured to compress refrigerant, an accumulator 25 configured to separate and store liquid refrigerant failed to be evaporated in an evaporator (the indoor heat exchanger 11, the outdoor heat exchanger 21), a four-way valve 26 configured to switch a refrigerant flow direction, a check valve 29 configured to allow a flow from the compressor 24 to the four-way valve 26 and inhibit a backward flow thereof, a bypass pipe (a bypass path) 28 connecting a discharge side of the compressor 24 and a suction side of the accumulator 25, and an on-off valve (configured to open/close the bypass pipe 28) 27 configured to control a flow in the bypass pipe 28.

Moreover, various sensors are used for collecting information necessary for control of the air conditioner 1. For example, the outdoor device 200 includes a pressure sensor 66 configured to detect a refrigerant pressure (hereinafter referred to as a "discharge pressure") on the discharge side of the compressor 24, a pressure sensor 65 configured to detect a refrigerant pressure (hereinafter referred to as a "suction pressure") on the suction side of the accumulator 25, a temperature sensor 61 configured to detect a refrigerant temperature on the discharge side of the compressor 24, temperature sensors 62, 63 configured to detect refrigerant temperatures at an outlet and an inlet of the outdoor heat exchanger 21, and a temperature sensor 64 configured to detect an external air temperature.

Moreover, the outdoor device 200 is provided with an electric box, and a control device 70 is provided in the electric box. The control device 70 is electrically connected to the indoor expansion valve 12, the on-off valve 27, the temperature sensors 61 to 64, and the pressure sensors 65, 66. The temperature sensors 61 to 64 and the pressure sensors 65, 66 transmit, to the control device 70, signals corresponding to measurement results. The indoor expansion valve 12 and the on-off valve 27 operate based on signals transmitted from the control device 70. The control device 70 is configured such that a microcomputer and peripheral circuits are mounted on a substrate, for example. The microcomputer implements various types of processing in such a manner that a control program stored in a read only memory (ROM) is read and loaded into a random access memory (RAM) and is executed by a central processing unit (CPU). The peripheral circuits include, for example, an A/D converter, various motor drive circuits, and a sensor circuit. Moreover, the control device 70 is configured to acquire each temperature detected by the temperature sensors 61 to 64, the suction pressure (a pressure on a suction side of the compressor) detected by the pressure sensor 65, and the discharge pressure (the pressure on the discharge side of the compressor) detected by the pressure sensor 66.

Next, operation of the air conditioner 1 will be described with reference to FIG. 1. In FIG. 1, solid arrows indicate a refrigerant flow direction in cooling operation, and dashed arrows indicate a refrigerant flow direction in heating operation.

In the cooling operation, the outdoor heat exchanger 21 functions as a condenser, and the indoor heat exchanger 11 functions as the evaporator. As indicated by the solid arrows, refrigerant is compressed by the compressor 24, and is discharged in the form of high-pressure high-temperature gas. Thereafter, the refrigerant releases heat to the external air sent by the outdoor fan 23 in the outdoor heat exchanger 21 by way of the four-way valve 26, and therefore, is condensed. Then, the refrigerant in the form of high-pressure intermediate-temperature liquid passes through the outdoor expansion valve 22, the pipe 52, and the indoor expansion valve 12, and is decompressed into a low-pressure low-temperature gas-liquid two-phase state. Then, the gas-liquid two-phase refrigerant takes heat from the indoor air sent by the indoor fan 13 in the indoor heat exchanger 11, and therefore, is evaporated. Accordingly, the refrigerant turns into a low-pressure low-temperature gas state. Then, the gas refrigerant flows into the accumulator 25 through the pipe 51 and the four-way valve 26, and liquid refrigerant failed to be evaporated in the indoor heat exchanger 11 is separated. Thereafter, the refrigerant is sucked into the compressor 24.

Meanwhile, when the refrigerant flow direction is switched by the four-way valve 26, the heat operation is brought. In this case, the outdoor heat exchanger 21 functions as the evaporator, and the indoor heat exchanger 11 functions as the condenser. As indicated by the dashed arrows, refrigerant circulates, in the air conditioner 1, through the compressor 24, the four-way valve 26, the pipe 51, the indoor heat exchanger 11, the indoor expansion valve 12, the pipe 52, the outdoor expansion valve 22, the outdoor heat exchanger 21, the four-way valve 26, the accumulator 25, and the compressor 24 in this order while changing the state thereof.

Figure 2:
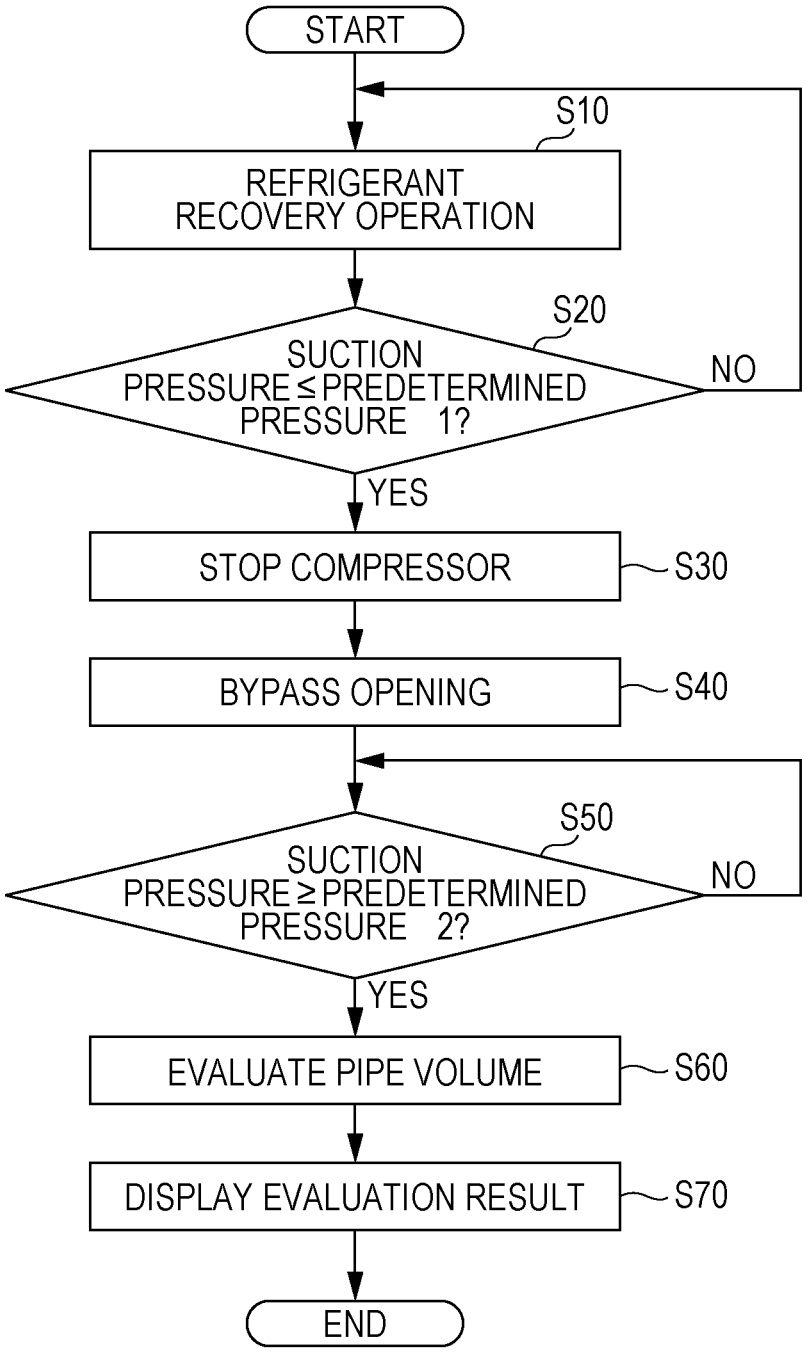
FIG. 2 is a flowchart of the process of evaluating a pipe volume according to the present embodiment.
Figure 3:
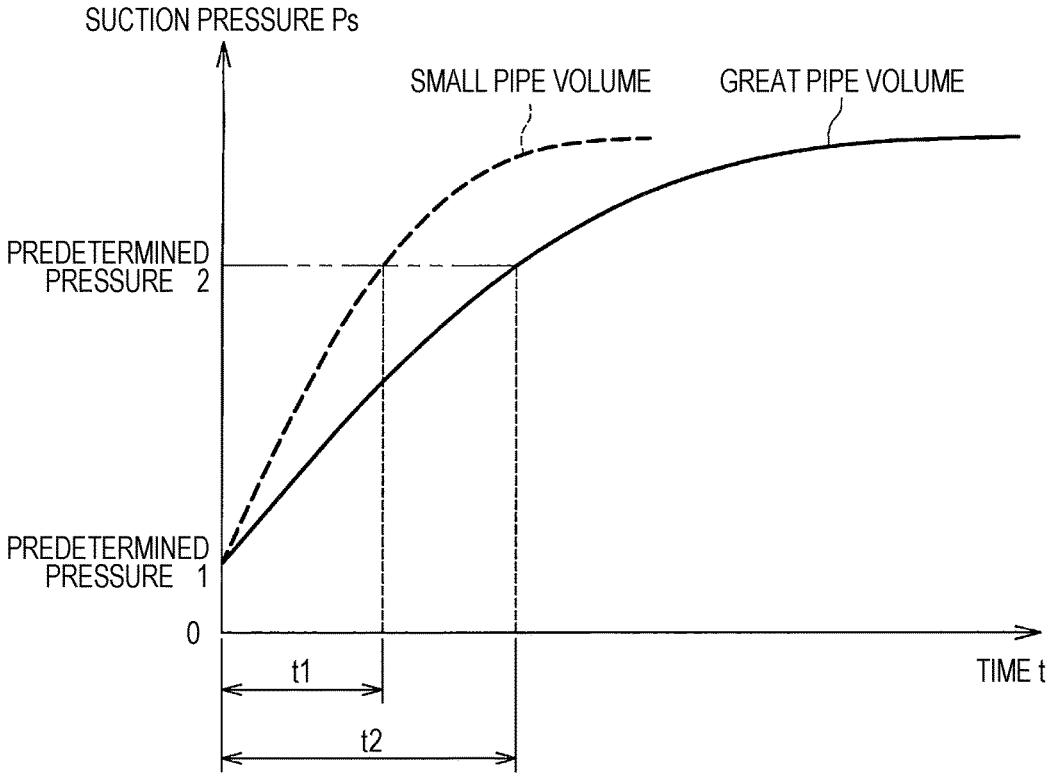
FIG. 3 is a graph of a suction pressure change in a bypass opening process.

Hereinafter, the method for evaluating a pipe volume will be described as a feature of the present embodiment with reference to FIGS. 2 and 3 (as necessary, with reference to FIG. 1). FIG. 2 is a flowchart of the process of evaluating the pipe volume according to the present embodiment, and FIG. 3 is a graph of a suction pressure change in a bypass opening process.

Generally, a certain amount of refrigerant is enclosed in advance within the outdoor device 200 upon shipment of the air conditioner 1. Moreover, after installation of the air conditioner 1 has been completed, additional refrigerant is also enclosed as necessary. For example, addition of refrigerant is not necessary when a pipe length is equal to or shorter than a specified length, and is necessary when the pipe length exceeds the specified length. In view of such a situation, the process of performing pipe volume evaluation in a state in which the air conditioner 1 holds refrigerant will be described.

As illustrated in FIG. 2, the control device 70 executes refrigerant recovery operation at a step S10. That is, the control device 70 switches the four-way valve 26 to a state indicated by a dashed line in FIG. 1 before start-up of the compressor 24, and brings the indoor expansion valve 12 and the on-off valve 27 into a fully-closed state. Accordingly, the compressor discharge side (the discharge side of the compressor 24) including the indoor heat exchanger 11 and the pipe 51 is isolated from the compressor suction side (the suction side of the compressor 24) including the pipe 52, the outdoor heat exchanger 21, the accumulator 25, and the compressor 24. Then, the control device 70 operates the compressor 24 to send refrigerant on the compressor suction side to the compressor discharge side. Accordingly, the pressure of the refrigerant increases on the compressor discharge side, and decreases on the compressor suction side.

At a step S20, the control device 70 determines whether or not the suction pressure Ps (the pressure on the compressor suction side) detected by the pressure sensor 65 is a predetermined pressure 1 such as equal to or lower than 0.3 MPa. In a case where the control device 70 determines that the suction pressure is not equal to or lower than the predetermined pressure 1 (S20, No), the processing of recovering refrigerant on the compressor suction side and sending the refrigerant to the compressor discharge side is continued. In a case where the control device 70 determines that the suction pressure is equal to or lower than the predetermined pressure 1 (S20, Yes), the processing proceeds to processing of a step S30. Note that the predetermined pressure 1 is preferably set to such a minimum valve (the minimum valve that the compressor 24 is not damaged) that the compressor 24 can be protected.

At the step S30, the control device 70 stops the compressor 24. Accordingly, a refrigerant storage state as a state in which refrigerant is stored on the compressor discharge side is brought, and a substantially vacuum state as a state in which almost no refrigerant is held on the compressor suction side is brought. Note that for reducing influence on the accuracy of evaluation on refrigerant remaining on the compressor suction side, the suction pressure at the end of the refrigerant recovery operation may be set low within such a range that the air conditioner 1 can be operated. In the case of an air conditioner configured such that an outdoor device 200 includes multiple compressors 24, all compressors may be operated.

At a step S40, the control device 70 executes bypass opening. That is, the control device 70 opens the on-off valve 27, and starts time counting (starts a timer). In this case, the on-off valve 27 is opened such that refrigerant flows, through the bypass pipe 28, from the high-pressure compressor discharge side on which most of refrigerant in the air conditioner 1 is housed to the (substantially vacuum) compressor suction side on which almost no refrigerant is held. Then, as refrigerant on the compressor suction side increases, the discharge pressure Pd (the pressure on the discharge side of the compressor 24) detected by the pressure sensor 66 decreases, and the suction pressure Ps (the pressure on the suction side of the compressor 24) detected by the pressure sensor 65 increases.

In this bypass opening process, a detection value of each sensor is acquired at certain time intervals such as every one second, and is stored in a predetermined storage device (a memory). Note that each sensor indicates the pressure sensors 65, 66 and the temperature sensors 61, 62, 63, 64 (see FIG. 1). Note that the refrigerant state (e.g., the gas state or the gas-liquid two-phase state) can be checked from the temperature sensors 61, 62, 63, and the temperature sensors 61, 62, 63 may be selected and used as necessary.

At a step S50, the control device 70 determines whether or not the suction pressure Ps detected by the pressure sensor 65 is equal to or higher than a predetermined pressure 2. In a case where the control device 70 determines that the suction pressure is equal to or higher than the predetermined pressure 2 (S50, Yes), the processing proceeds to processing of a step S60. In a case where the control device 70 determines that the suction pressure is not equal to or higher than the predetermined pressure 2 (S50, No), the processing of the step S50 is repeated. Note that the predetermined pressure 2 is a threshold for termination of time counting after opening of the on-off valve 27 and transition to pipe volume evaluation.

As illustrated in FIG. 3, in the case of a small pipe volume (see a dashed line), a time t1 required for the suction pressure Ps to increase to the predetermined pressure 2 is short. In the case of a great pipe volume (see a solid line), a time t2 required for the suction pressure Ps to increase to the predetermined pressure 2 is long (t1<t2).

Returning to FIG. 2, the control device 70 executes pipe volume evaluation at the step S60. That is, the volume of the pipe 52 is evaluated using the detection value of each sensor (the pressure sensors 65, 66 and the temperature sensor 64) acquired in the bypass opening process of the step S40.

Specifically, the pipe between the compressor 24 and a connection port 31 is heated by high-temperature gas discharged from the compressor 24 in the refrigerant recovery operation. Thus, refrigerant flowing from the compressor discharge side to the bypass pipe 28 is held in the form of gas within a certain time. The refrigerant is held in the form of gas as described above because the compressor 24 is made of iron with a great thermal capacity, the pipe 51 is made of copper with a great thermal capacity, and the compressor 24 and the pipe 51 are less coolable, for example.

When a pressure difference ΔP (=the discharge pressure Pd—the suction pressure Ps) at the bypass pipe 28 is equal to or greater than ½ of the inlet pressure (=the discharge pressure Pd) of the bypass pipe 28, the amount of refrigerant passing through the bypass pipe 28 per unit time depends only on the inlet pressure and the inlet temperature. The inlet pressure is detected by the pressure sensor 66, and corresponds to the discharge pressure Pd. The inlet temperature is detected by the temperature sensor 61, and corresponds to a discharge temperature Td.

That is, in a case where fluid flowing in a certain path is gas, when the pressure difference ΔP is less than ½ of the inlet pressure, a flow rate Q is generally proportional to (ΔP·Pm)/(G·T). However, when the pressure difference ΔP is equal to or greater than ½ of the inlet pressure, a choked flow is brought, and the flow rate Q is proportional to P1/(G·T). Pm is an average absolute pressure ((P1+P2)/2), G is a specific gravity, T is a temperature, P1 is an inlet pressure, and P2 is an outlet pressure. Moreover, the specific gravity G can be estimated from the pressure and the temperature.

Thus, the pressure difference ΔP at the bypass pipe 28 is set to equal to or greater than ½ of the inlet pressure (=the discharge pressure Pd) of the bypass pipe 28, so that the flow rate (the amount of refrigerant passing through the bypass pipe 28) can be estimated by a relatively-simple expression (the discharge pressure (the inlet pressure) Pd and the discharge temperature (the inlet temperature) Td). That is, the amount of refrigerant flowing to the compressor suction side can be easily and accurately estimated.

On the other hand, on the compressor suction side, when the refrigerant pressure (=the suction pressure Ps) is lower than a saturated pressure corresponding to the external air temperature (a surrounding temperature), i.e., the refrigerant temperature is lower than the external air temperature, refrigerant is held in the form of gas without condensation. The refrigerant is held in the form of gas as described above, and therefore, a pressure increase (the suction pressure change) in association with an increase in refrigerant on the compressor suction side is influenced only by the volume. That is, as illustrated in FIG. 3, an increase in the suction pressure Ps is accelerated in the case of a small pipe volume, and is decelerated in the case of a great pipe volume. Note that the elapsed times t1, t2 illustrated in FIG. 3 correspond to a time required for a pressure change (the predetermined pressure 2—the predetermined pressure 1). Note that when refrigerant condensation occurs and the gas-liquid two-phase state is brought, the refrigerant pressure is held at the saturated pressure even when refrigerant on the compressor suction side increases. That is, no change is made, and therefore, there is a probability that the pipe volume cannot be evaluated with favorable accuracy. Thus, for ensuring the accuracy of pipe volume evaluation, it is set such that the predetermined pressure 2 corresponding to the compressor suction side pressure at the end of bypass opening does not exceed the saturated pressure corresponding to the external air temperature. In short, the predetermined pressure 2 is set such that the pressure difference ΔP at the bypass pipe 28 is equal to or greater than ½ of the inlet pressure (=the discharge pressure Pd) of the bypass pipe 28 and the predetermined pressure 2 is lower than the saturated pressure corresponding to the external air temperature detected by the temperature sensor 64.

Thus, the volume of the compressor suction side including the pipe 52, the outdoor heat exchanger 21, the accumulator 25, and the compressor 24 can be obtained from the change (the suction pressure change) in the suction pressure and the amount of refrigerant flowing from the compressor discharge side to the compressor suction side in the bypass opening process of the step S40. Each volume of the outdoor heat exchanger 21, the accumulator 25, and the compressor 24 is known, and therefore, the volume (the pipe volume) of the pipe 52 can be obtained in such a manner that each volume of the outdoor heat exchanger 21, the accumulator 25, and the compressor 24 is subtracted from the obtained volume of the compressor suction side. Moreover, when the pipe diameter of the pipe 52 is obtained, the length (the pipe length) of the pipe 52 can be calculated. Note that the length of the pipe 52 is the same as that of the pipe 51.

As described above, in a case where the pressure difference ΔP is equal to or greater than ½ of the inlet pressure, the amount of refrigerant flowing from the compressor discharge side to the compressor suction side within a certain time depends on the inlet pressure (=the discharge pressure) and the temperature (=the discharge temperature). Meanwhile, the change (the suction pressure change) in the pressure on the compressor suction side is influenced by the volume and the increment (=the amount of refrigerant flowing from the compressor discharge side to the compressor suction side) of held refrigerant. Using these parameters, the volume of the compressor suction side can be represented by the function of the suction pressure change, the time required for the suction pressure change, the discharge pressure, and the discharge temperature. Thus, such a relationship is obtained in advance, so that the volume of the pipe 52 can be relatively easily evaluated.

For example, the pipe volume can be represented by V=f(Pd, Td, ΔPs, t). Note that Pd indicates the discharge pressure, and is a value detected by the pressure sensor 66. Td indicates the discharge temperature, and is a value detected by the temperature sensor 61. ΔPs indicates the change in the suction pressure and is a change in a value detected by the pressure sensor 65, and t indicates an elapsed time after opening of the on-off valve 27.

Note that the discharge temperature Td provides less influence than other parameters, and therefore, depending on required accuracy, it may be determined whether or not the discharge temperature Td is employed. Moreover, the discharge pressure Pd varies according to a device or the amount of held refrigerant, and cannot be controlled. Thus, when the suction pressure change and the time required for the suction pressure change are initially set according to equipment, any one of these parameters is constant as a predetermined value. That is, as illustrated in FIG. 3, the suction pressure Ps is set to the predetermined pressure 2. Thus, the volume is obtained using the discharge pressure Pd and the time t according to the above-described expression.

Then, at a step S70, the control device 70 displays an evaluation result. For example, an estimated value of the volume of the pipe 52 is displayed on a display of the air conditioner 1. Note that the display may display the estimated value by means of an LED provided on the substrate of the electric box in the outdoor device 200, or may display the estimated value on a liquid crystal screen of a remote controller of the air conditioner 1.

In the present embodiment, the compressor suction side pressure change used for evaluation of the pipe volume depends only on the pipe volume and the increment of held refrigerant (the amount of refrigerant flowing from the compressor discharge side to the compressor suction side), and therefore, detailed specifications such as a pipe shape do not need to be grasped. Moreover, even when proper refrigerant is not enclosed or the air temperature is low, refrigerant recovery and pipe volume evaluation can be executed. Further, less parameters required for evaluation of the pipe volume are employed. Thus, influence of a detection error of the sensor on the evaluation accuracy can be reduced, and the pipe volume can be accurately evaluated.

As described above, the air conditioner 1 of the present embodiment includes the outdoor device 200 having the compressor 24 and the outdoor heat exchanger 21, the indoor device 100 having the indoor heat exchanger 11 and the indoor expansion valve 12, and the pipes 51, 52 connecting the outdoor device 200 and the indoor device 100. The outdoor device 200 includes the bypass pipe 28 connecting the discharge side of the compressor 24 and the suction side of the compressor 24, the on-off valve 27 configured to open/close the bypass pipe 28, and the control device 70 configured to control the compressor 24, the indoor expansion valve 12, and the on-off valve 27. The control device 70 opens the on-off valve 27 in a state in which the compressor 24 is stopped to execute such bypass opening that refrigerant circulates, through the bypass pipe 28, from the discharge side of the compressor 24 in the refrigerant storage state in which refrigerant is stored to the suction side of the compressor 24 in the substantially vacuum state. Based on the discharge pressure Pd of the compressor 24 and the time t required for the suction pressure change ΔPs of the compressor 24 in bypass opening, the volumes of the pipes 51, 52 connecting the outdoor device 200 and the indoor device 100 are evaluated (the volumes are obtained). According to this configuration, the volumes of the pipes 51, 52 can be accurately evaluated (obtained) using less parameters.

Moreover, in the present embodiment, the control device 70 operates the compressor 24 in a state in which the indoor expansion valve 12 is fully closed before execution of bypass opening, and executes the refrigerant recovery operation of sending refrigerant on the suction side of the compressor 24 to the discharge side of the compressor 24. Accordingly, the suction side of the compressor 24 is brought into the substantially vacuum state, and the discharge side of the compressor 24 is brought into the refrigerant storage state. Thus, evaluation of the pipe volume can be properly performed.

Further, in the present embodiment, the pressure difference ΔP at the bypass pipe 28 upon bypass opening is equal to or greater than ½ of the pressure (the compressor discharge side pressure) at the inlet of the bypass pipe 28. Accordingly, the amount of refrigerant flowing on the compressor suction side can be estimated according to a simple calculation expression with less parameters, and therefore, the accuracy of pipe evaluation can be enhanced.

In addition, in the present embodiment, the suction pressure Ps of the compressor 24 at the end of bypass opening is set lower than the saturated pressure (the predetermined pressure 2) corresponding to the external air temperature (the surrounding temperature). Accordingly, refrigerant is held in the form of gas, and therefore, the accuracy of pipe evaluation can be enhanced.

Note that in the above-described embodiment, the configuration in which a single outdoor device and a single indoor device are connected to each other has been described as the air conditioner 1 by way of example. However, the present disclosure may be, as variations, applied to a configuration in which multiple indoor devices are connected to a single outdoor device and a configuration in which multiple outdoor devices and multiple indoor devices are connected to each other.

Figure 4:
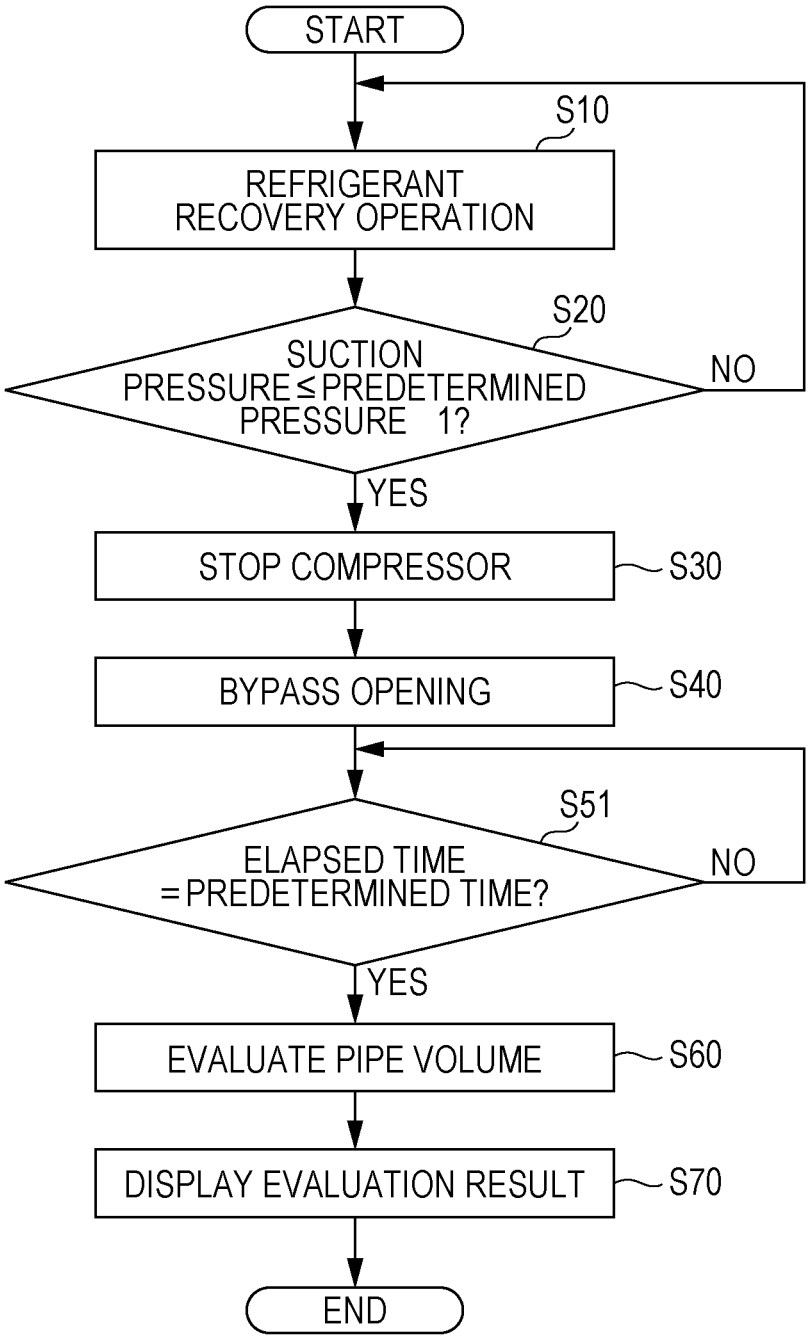
FIG. 4 is a flowchart of the process of evaluating the pipe volume according to a variation of the present embodiment.
Figure 5:
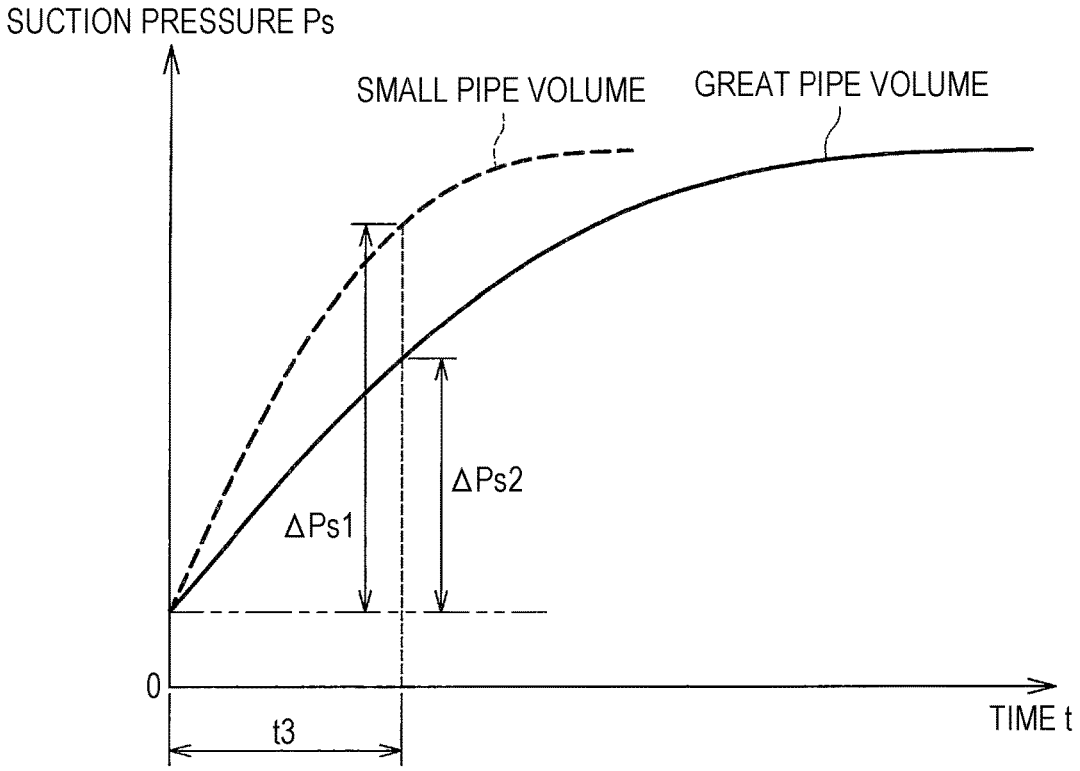
FIG. 5 is a graph of the suction pressure change in the bypass opening process.

FIG. 4 is a flowchart of the process of evaluating the pipe volume according to a variation of the present embodiment, and FIG. 5 is a graph of the suction pressure change in the bypass opening process. Note that in FIG. 4, a step S51 is provided instead of the step S50 of the flowchart of FIG. 2, and only differences will be described hereinafter.

As illustrated in FIG. 4, at the step S51, the control device 70 determines whether or not the elapsed time after the start of bypass opening (opening of the on-off valve 27) reaches a predetermined time. In a case where the control device 70 determines that the predetermined time has not elapsed yet (S51, No), the processing of the step S51 is repeated. In a case where the control device 70 determines that the predetermined time has elapsed (S51, Yes), the processing proceeds to the processing of the step S60. Note that the predetermined time is a threshold for termination of time counting and transition to evaluation of the pipe volume, and the pressure difference ΔP at the bypass pipe 28 at the end of bypass opening is set to be equal to or greater than ½ of the pressure (the compressor discharge side pressure) at the inlet of the bypass pipe 28.

In pipe volume evaluation of the step S60, the pipe volume V can be represented by the function of V=f(Pd, Td, ΔPs, t), for example. Note that t indicates the time required for the suction pressure change, and is a value detected by the timer.

As illustrated in FIG. 5, when a time t3 elapsed after opening of the on-off valve 27 is set, the suction pressure change ΔPs1, ΔPs2 at the elapsed time t3 is obtained. For example, in the case of a small pipe volume, the suction pressure change ΔPs1 is great. In the case of a great pipe volume, the suction pressure change ΔPs2 is small. That is, an increase in the suction pressure is faster in the case of the small volume, and a greater pressure change is shown within a certain time (the elapsed time t3) after opening of the on-off valve 27. Note that the time t3 is set such that the suction pressure Ps (the compressor suction pressure at the end of bypass opening) when the time t3 has elapsed is lower than the saturated pressure corresponding to the surrounding temperature.

As described above, in the embodiment illustrated in FIGS. 4 and 5, the time t3 required for the pressure change ΔPs (ΔPs1, ΔPs2) on the compressor suction side is set, so that evaluation of the pipes 51, 52 can be accurately performed using the suction pressure change ΔPs and the discharge pressure Pd according to the above-described function.

Note that in the above-described embodiment, the case where the refrigerant recovery operation is executed has been described by way of example with reference to FIGS. 2 and 4. However, the pipe volume may be evaluated without execution of the refrigerant recovery operation. For example, a case where the indoor device 100 is in the refrigerant storage state and the outdoor device 200 in the substantially vacuum state is connected to the indoor device 100 is conceivable. This case can be started from bypass opening operation (the step S40) without execution of the refrigerant recovery operation (the steps S10 to S30).

Moreover, the pipe volume may be, without setting of any of the suction pressure change ΔPs of the compressor 24 and the time t required for the suction pressure change ΔPs of the compressor 24, evaluated based on the discharge pressure Pd of the compressor 24, the suction pressure change ΔPs of the compressor 24, and the time t required for the suction pressure change ΔPs of the compressor 24.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An air conditioner comprising:

an outdoor device including a compressor and an outdoor heat exchanger;

an indoor device including an indoor heat exchanger and a decompression device; and a pipe connecting the outdoor device and the indoor device, wherein the outdoor device includes a bypass path connecting a discharge side of the compressor and a suction side of the compressor, an on-off valve configured to open/close the bypass path, and a control device configured to control the compressor, the decompression device, and the on-off valve, and the control device opens the on-off valve in a state in which the compressor is stopped to execute such bypass opening that refrigerant circulates, through the bypass path, from the discharge side of the compressor in a refrigerant storage state in which refrigerant is stored to the suction side of the compressor in a substantially vacuum state, and evaluates a volume of the pipe connecting the outdoor device and the indoor device based on at least one of a pressure on the discharge side of the compressor, a pressure change on the suction side of the compressor and a time required for the pressure change on the suction side of the compressor in the bypass opening.

2. The air conditioner according to claim 1, wherein the control device operates the compressor in a state in which the decompression device is fully closed before execution of the bypass opening to execute refrigerant recovery operation for sending refrigerant from the suction side of the compressor to the discharge side of the compressor, thereby bringing the suction side of the compressor into the substantially vacuum state and bringing the discharge side of the compressor into the refrigerant storage state.

3. The air conditioner according to claim 1, wherein upon the bypass opening, a pressure difference at the bypass path is equal to or greater than ½ of a pressure at an inlet of the bypass path.

4. The air conditioner according to claim 1, wherein a pressure on the suction side of the compressor at an end of the bypass opening is lower than a saturated pressure corresponding to a surrounding temperature.

* * * * *